US005188252A

United States Patent [19]

Gerhard

[11] Patent Number: 5,188,252

[45] Date of Patent: Feb. 23, 1993

[54] FREIGHT CONTAINER

[75] Inventor: Helmut Gerhard, Weitefeld, Fed. Rep. of Germany

[73] Assignee: Eisenwerk Gerhard GmbH, Fed. Rep. of Germany

[21] Appl. No.: 899,922

[22] Filed: Jun. 17, 1992

[30] Foreign Application Priority Data

Jun. 17, 1991 [DE] Fed. Rep. of Germany ... 9107448[U]

[51] Int. Cl.[5] ..... B65D 19/00

[52] U.S. Cl. ..... 220/1.5; 410/77

[58] Field of Search ..... 220/1.5; 410/54, 77, 410/84, 90

[56] References Cited

U.S. PATENT DOCUMENTS

| | | | |
|---|---|---|---|
| 3,449,801 | 6/1969 | Lafont et al. | 220/1.5 X |
| 3,480,174 | 11/1969 | Sherwood | 220/1.5 |
| 3,693,920 | 9/1972 | Trautman | 410/77 |
| 3,807,581 | 4/1974 | Nichols | 220/1.5 |
| 4,108,326 | 8/1978 | Bertolini | 220/1.5 |
| 4,758,123 | 7/1988 | Corompt | 410/77 |
| 4,844,672 | 7/1989 | Yurgevich | 220/1.5 X |
| 4,925,349 | 5/1990 | Yurgevich | 220/1.5 X |
| 5,115,933 | 5/1992 | Gerhard | 220/1.5 |

FOREIGN PATENT DOCUMENTS

| | | |
|---|---|---|
| 0401639 | 12/1990 | European Pat. Off. . |
| 2413440 | 10/1975 | Fed. Rep. of Germany . |
| 3811669 | 10/1988 | Fed. Rep. of Germany . |

*Primary Examiner*—Steven M. Pollard

*Attorney, Agent, or Firm*—Evenson, Wands, Edwards, Lenahan & McKeown

[57] ABSTRACT

To enable small or medium-size containers to be directly secured to locking members existing on vehicle loading areas for ISO containers and to be placed in ISO containers or ISO container frames, only one (23) of two fittings (23, 27) provided at opposite container ends is rigidly mounted whereas the other (27) is foldable between an operative position in which it projects beyond the outer dimension of the container, and a rest position in which it is inside the outer container dimension.

7 Claims, 2 Drawing Sheets

FREIGHT CONTAINER

BACKGROUND OF THE INVENTION

The invention relates to a freight container with two fittings, which are disposed at those two ends of the container that are opposite each other along a first axis, for engaging locking members provided on a container receiving surface. Either fitting has openings for simultaneously engaging a pair of locking members provided on a vehicle loading area at a spacing of substantially 280 mm in the direction of a second axis, which extends perpendicularly to the first axis. The centre spacing between openings of those two fittings, which are opposite each other in the direction of the first axis, is substantially 2259 mm.

A freight container of this type is known from European Patent Application 0,401,639. As explained therein, loading areas of railway cars or trucks are provided with spigots and, respectively, twistlocks in a specific arrangement which includes a plurality of locations where two adjacent locking members are spaced by approx. 280 mm. In the prior art, this fact is utilised for securing small or middle- size containers which have no standard dimensions and therefore cannot be coupled at all four corners to locking members; due to being fixed at a total of four points, they may yet be fastened in such a way that they are secured against tilting.

In the known freight container, the two double or multiple fittings are rigidly mounted on two opposite container sides and extend beyond the dimension of the tank. In a skillful arrangement and by omitting individual stanchions, several of such containers may be arranged on one flat which in turn can be provided with standardised corner fittings. However, the known small or medium-size containers, due to their protruding fittings, cannot be received in a container frame such as disclosed in U.S. Pat. No. 4,629,085.

SUMMARY OF THE INVENTION

It is an object of the present invention to provide a freight container which, on the one hand, may be directly secured to locking members as they are provided on loading areas of vehicles for the transport of ISO unit loads and, on the other hand, may be inserted into ISO containers or ISO container frames.

To met this object, the invention provides a freight container having a first axis and a second axis extending perpendicularly to the first axis and comprising two fittings, which are disposed at those two ends of the container that are opposite each other along the first axis, for engaging locking members provided on a container receiving surface, each fitting having openings for simultaneously engaging a pair of locking members provided on a vehicle loading area at a spacing of substantially 280 mm in the direction of the second axis, wherein the centre spacing between openings of those two fittings, which are opposite each other in the direction of the first axis, is substantially 2259 mm, and wherein at least one of the fittings is foldable about a pivot axis, which extends parallel to the second axis, between a locking position, in which the one fitting is capable of engaging a locking member, and a rest position, in which the one fitting is inside the outer container dimension measured in the direction of the first axis.

The foldability of (at least) one of the multiple fittings provided at both container ends results, in the locking position of the respective fitting, in an overall dimension in which the centre spacing between the openings of the two fittings corresponds to the ISO dimension of 2259 mm, whereas, in the folded-away rest position, an outer container dimension is achieved which permits this container to be placed in an ISO container or ISO container frame.

In a preferred embodiment, the other fitting is rigidly mounted and is disposed within the outer container dimension measured in the direction of the first axis. A mechanically inexpensive solution is thereby achieved. While this solution results in that the container, when directly fixed to the loading area of a vehicle, has its centre of gravity slightly laterally offset from the longitudinal axis of the loading area, such asymmetry in typical dimensions amounts to only 80 mm and can be tolerated. When two containers are handled in pairs, as is common in the trade, and rotated 180° with respect to each other, this asymmetry is even completely compensated.

In a further embodiment of the invention, the one fitting includes a plate which is mounted by substantially triangular support plates extending perpendicular to the surface of the plate, for being folded about a pivot axis, which is disposed above a base surface of said container and within the outer container dimension. This structure renders it possible to support the container on the foldable fitting in a manner capable of transmitting loads, wherein the pivot axis is within the container profile in the vertical and horizontal directions and is thus protected against damage.

The freight container may comprise a cylindrical tank having end bottoms and saddle rings mounted on these end bottoms, one of the saddle rings being provided with a bearing arrangement for the one fitting.

Advantageously, either fitting may have more than three openings at mutual centre spacings of substantially 140 mm, and both fittings may be disposed symmetically with respect to said first axis. The number of positions in which the container can be secured to the locking members provided on a loading area may thus be increased.

DETAILED DESCRIPTION OF A PREFERRED EMBODIMENT

Figure 1:
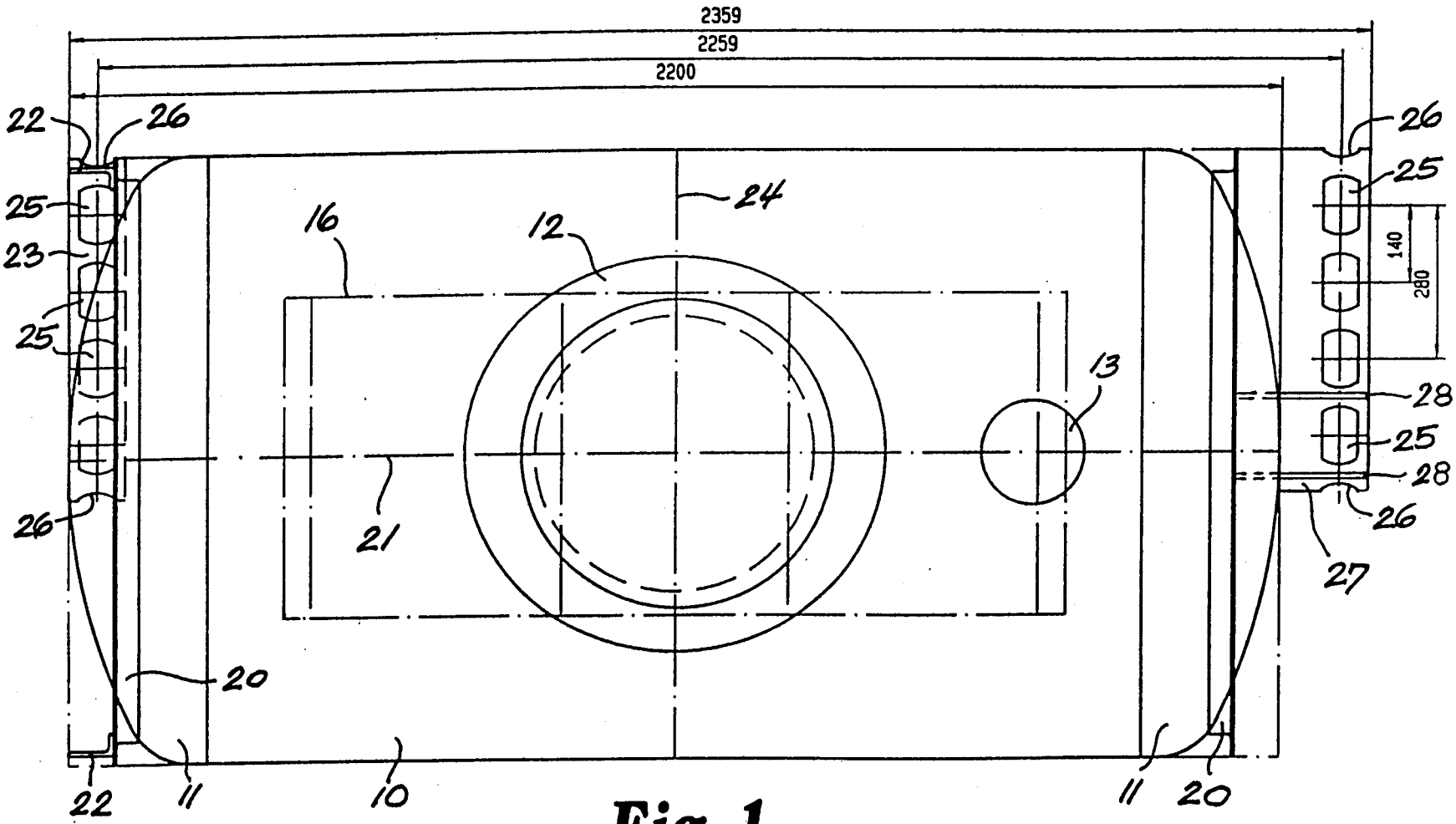
FIG. 1 is a plan view showing a tank container according to an embodiment of the invention.

The container shown in the drawings consist essentially of a horizontal cylindrical tank 10 having end bottoms 11, an upper raised manhole 12, a further top-mounted armature 13, and a bottom outlet 14.

By means of supports 15 connected to the lower portion of the tank envelope, the tank 10 rests on a rectangular foot structure 16, through which two fork-lift channels 17 extend. As shown in phantom lines in the plan view of FIG. 1, the rectangular foot structure 16 has outer dimensions which amount to approximately one-half only of the outer dimensions of the tank. This foot structure permits the tank to be inserted into a recess of an ISO container frame (such as disclosed in U.S. Pat. No. 4,629,085.

A saddle ring 20 having an axial flange extending parallel to the longitudinal axis 21 of the tank 10 is welded to either tank bottom 11. Two upright L-bars 22 are welded to the radial flange of the saddle ring shown at the left in FIGS. 1 and 2, which L-bars have upper ends slightly above the profile of the raised manhole 12 and armature 13, and lower ends in the area of the base plane of the container defined by the lower surface of the foot structure 16. Providing corner struts also at the other saddle ring (which is not shown in the drawings) results in a roll-over protection and makes the container stackable.

A fitting 23 is rigidly connected to the lower end of one of the two L-bars 22, which fitting is formed as an elongate plate extending parallel to the transverse axis 24 of the tank 10 and is provided with a total of four oblong openings 25 and two end recesses 26. The oblong form of the openings 25 corresponds to that of ISO twistlocks with a clearance of 3 mm at all sides.

Figure 2:
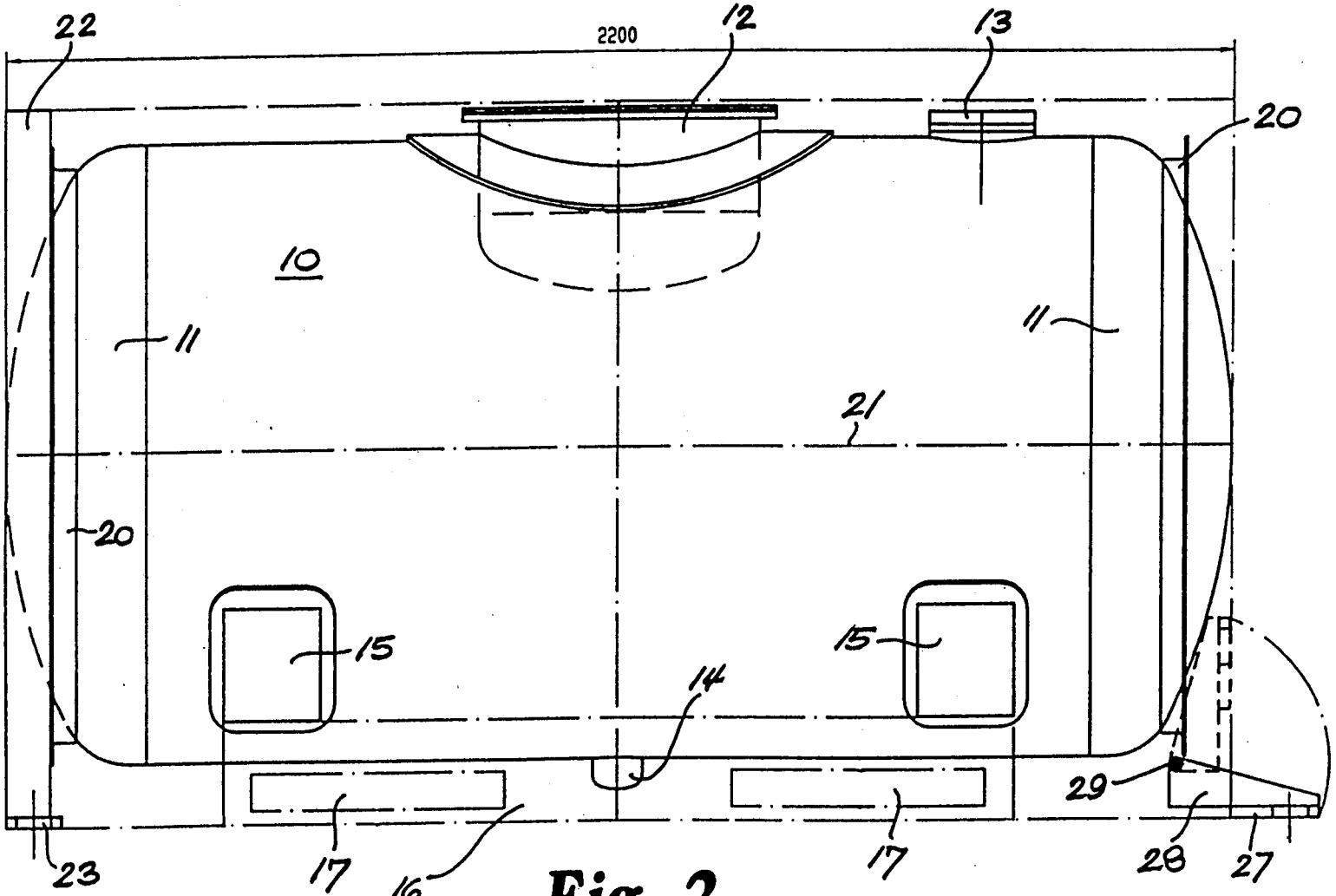
FIG. 2 is a side view of the tank container of FIG. 1.

A second fitting 27 in the form of a plate, which is similarly shaped but wider in the direction of the longitudinal axis 21 of the tank 10, is provided at the right-hand end of the container as viewed in FIGS. 1 and 2.

This fitting 27 is provided with two (or more) approximately triangular support plates 28 which extend vertically upwardly and are mounted, by means of a pivot arrangement provided in the lower area of the radial flange of the right-hand saddle ring 20, for rotation about a pivot axis 29 which extends parallel to the transverse axis 24 of the tank 10. The fitting 27 may thus be folded upwardly by 90° from the locking position shown in solid lines in FIG. 2 into the rest position shown in dotted lines in FIG. 2. Locking means (not shown) are provided for locking the fitting 27 in both the fixing position and the rest position.

In both fittings 23 and 27, the centre spacing between each pair of adjacent openings 25 is 140 mm. The width of the web between adjacent openings 25 is the same as that between the last opening 25 and the adjacent end recess 26. Therefore, there are four different positions in which the container may be secured to locking members (spigots or twistlocks) which exist on the respective vehicle loading area at a spacing of approx. 280 mm.

Further, since the two fittings 23 and 27 are symmetrically disposed with respect to the longitudinal tank axis 21, rotating the container by 180° provides a total of eight different positions in which the container may be secured to the loading area.

As indicated in FIG. 1, the tank has an overall length of approx. 2200 mm. The rigidly fixed left-hand fitting is within this outer dimension. As is clear from FIG. 2, the right-hand fitting 27 in the upwardly folded rest position is also within the outer dimension of 2200 mm. In this position, the tank container may be placed in an ISO container or ISO container frame (e.g. a bulk-box, a flat having stanchions, or even a cooling container).

However, in the operative position of the right-hand fitting 27 shown in FIG. 1, the overall length of the container including this fitting 27 is approx. 2359 mm. This dimension is within the overall width of ISO containers. The centre spacing between the openings 25 of the opposite fittings 23 and 27 is approx. 2259 mm which corresponds to the spacing between locking members provided on vehicle loading areas for ISO containers.

What is claimed is:

1. A freight container having a first axis and a second axis extending perpendicularly to said first axis and comprising two fittings, which are disposed at those two ends of the container that are opposite each other along said first axis, each fitting having openings for simultaneously engaging a pair of locking members provided on a vehicle loading area at a spacing of substantially 280 mm in the direction of said second axis, wherein the centre spacing between openings of those two fittings, which are opposite each other in the direction of said first axis, is substantially 2259 mm, and wherein at least one of said fittings is foldable about a pivot axis, which extends parallel to said second axis, between a locking position, in which said one fitting is capable of engaging a locking member, and a rest position, in which said one fitting is inside the outer container dimension measured in the direction of said first axis.

2. The freight container of claim 1, wherein the other one of said fittings is rigidly mounted.

3. The freight container of claim 1, wherein said other fitting is disposed within the outer container dimension measured in the direction of said first axis.

4. The freight container of claim 1, wherein said one fitting includes a plate which is mounted by substantially triangular support plates extending perpendicular to the surface of the plate, for being folded about a pivot axis, which is disposed above a base surface of said container and within the outer container dimension.

5. The freight container of claim 4, comprising a cylindrical tank having end bottoms and saddle rings mounted on said end bottoms, one of said saddle rings being provided with a bearing arrangement for said one fitting.

6. The freight container of claim 1, wherein either one of said fittings has more than three openings at mutual centre spacings of substantially 140 mm.

7. The freight container of claim 1, wherein both said fittings are disposed symmetrically with respect to said first axis.

* * * * *